US008464882B2

(12) United States Patent
Tirosh

(10) Patent No.: US 8,464,882 B2
(45) Date of Patent: Jun. 18, 2013

(54) CONTAINER AND VENTING MECHANISM ASSEMBLY

(76) Inventor: Tamir Tirosh, Menahemia (IL)

( * ) Notice: Subject to any disclaimer, the term of this patent is extended or adjusted under 35 U.S.C. 154(b) by 207 days.

(21) Appl. No.: 12/853,332

(22) Filed: Aug. 10, 2010

(65) Prior Publication Data

US 2012/0037587 A1 Feb. 16, 2012

(51) Int. Cl.

| | |
|---|---|
| ***A61J 9/00*** | (2006.01) |
| ***A61J 11/02*** | (2006.01) |
| ***A61J 11/04*** | (2006.01) |
| *A61J 11/045* | (2006.01) |

(52) U.S. Cl.
USPC ..... 215/11.1; 215/11.5; 215/11.6; 215/386; 220/203.01; 220/714

(58) Field of Classification Search
USPC ..... 215/11.1–11.5, 386, 310, 311; 220/203, 220/714; 29/52; 210/741, 136
See application file for complete search history.

(56) References Cited

U.S. PATENT DOCUMENTS

| | | | | | |
|---|---|---|---|---|---|
| 803,590 | A * | 11/1905 | Herb | 215/11.5 |
| 1,183,728 | A * | 5/1916 | Hamiel | 215/11.1 |
| 1,999,581 | A * | 4/1935 | Yager | 215/11.5 |
| 2,094,710 | A * | 10/1937 | Kurkjian | 215/11.1 |
| 2,434,611 | A * | 1/1948 | Hamiel | 215/11.5 |
| 2,811,270 | A * | 10/1957 | Kurkjian | 215/11.5 |
| 3,022,914 | A * | 2/1962 | Marsh et al. | 215/11.5 |
| 3,189,234 | A * | 6/1965 | Thomson | 222/542 |
| 3,286,864 | A * | 11/1966 | Patterson | 215/11.5 |
| 4,613,050 | A * | 9/1986 | Atkin et al. | 215/11.5 |
| 5,570,796 | A * | 11/1996 | Brown et al. | 215/11.5 |
| 5,620,462 | A * | 4/1997 | Valenti | 606/234 |
| 6,286,697 | B1 * | 9/2001 | Gasparini | 215/11.5 |
| 6,669,013 | B1 * | 12/2003 | Villanueva | 206/219 |
| 2003/0192851 | A1 * | 10/2003 | Ziegler | 215/11.5 |
| 2006/0060591 | A1 * | 3/2006 | Rohrig | 220/714 |
| 2007/0262041 | A1 * | 11/2007 | Smith | 215/11.5 |
| 2011/0198349 | A1 * | 8/2011 | Lane | 220/203.04 |

* cited by examiner

*Primary Examiner* — Mickey Yu
*Assistant Examiner* — Gideon Weinerth

(57) ABSTRACT

A venting assembly for a closed container having a lid and a container portion with a neck and a rim. The assembly comprises a venting unit having a substantially rigid ring having a lid-interfacing surface; and a resilient annular valve member having a one-way valve disposed at the inner wall of the neck. The assembly further comprises at least one air passageway leading from the ambient atmosphere to the one-way valve member; and a fixing mechanism adapted to prevent planar movement between the venting unit and the container.

19 Claims, 9 Drawing Sheets

CONTAINER AND VENTING MECHANISM ASSEMBLY

FIELD OF THE INVENTION

The present invention relates to closed containers, such as bottles, in particular a venting mechanism therefor.

For ease of description, the present bottle and venting mechanism assembly will mainly be described with respect to bottles, and in particular baby bottles; however, the assembly can find application in other closed containers such as "sport bottles", "bicycle bottles", food storage containers, and so on.

BACKGROUND OF THE INVENTION

It is often desirable to provide a venting mechanism for closed containers to allow equalization of pressure. For example, when storing a container with warm food in a refrigerator the container may be damaged or lose its seal due to warping of the lid when the warm air cools and contracts.

Another common example where a venting mechanism is desirable is with baby bottles where, without a venting mechanism, a partial vacuum typically results upon drinking which can lead to difficulty in suckling and a need to release this vacuum by taking the bottle out of the baby's mouth to allow air to flow in via the nipple's suckling aperture. To overcome this issue, many modern baby bottle designs include a venting mechanism. Most such venting mechanisms comprise a vent with a one-way valve in the nipple, usually in the nipple's flange; however some venting mechanisms are located at the bottom of the bottle, requiring a re-design of the bottle with a specific shape and additional parts.

However, such venting mechanisms are commonly fraught with functional/practical issues, for example they can allow leakage of baby formula and the vent can be undesirably affected if the nipple ring/collar is screwed shut too tightly or the collar sticks to the nipple flange. Venting devices in these nipple-integral vents are often skirts depending from the nipple's sealing flange that are designed to form a one-way valve in association with the inner wall of the bottle's neck. Such skirts tend to readily allow leakage, presumably due to slight or not so slight deformation, upon even small movement of the skirt/nipple; and which occurs whenever the nipple is secured to the bottle by the collar. This movement is most likely due to twisting of the nipple flange upon screwing of the collar (causing a rotational movement; or, a deformation due to sticking between the nipple flange and the bottle and/or collar). However such movement may alternatively (or additionally) be due to front-back or side to side movement.

In other words, the performance of most mechanisms for ventilating containers/bottles, especially baby bottles, the vent/valve is affected by the user, in particular upon closing the container/bottle. Bottles with a venting mechanism having a one-way vent valve integral with the nipple, or on the bottle neck as in the prior art, tend to leak due to a deformation of the valve caused by screwing the collar to secure the nipple on the bottle. The deformation is typically in the form of waviness or wrinkling of a so-called skirt valve. In addition, one-way skirt valves, e.g. as described in U.S. Pat. No. 2,736,446 and U.S. Pat. No. 4,613,050 require very tight tolerances (precise manufacturing) so that the skirt valve seats properly on the bottle neck.

To avoid some of the above issues, venting mechanisms located at the neck/mouth/rim of the bottle, but not integral to the nipple, have been disclosed for example in CN 2011/75461 (Zhujin Wang); and US 2009/0255895 (Kiehne); U.S. Pat. No. 2,876,773 (Witz); U.S. Pat. No. 5,284,261 (Zambuto); U.S. Pat. No. 5,791,503 Lyons and US 2006/262041 (Smith). However, these venting mechanisms suffer from one or more drawbacks including at least that they take up a significant space of the mouth opening; and/or the components themselves cannot be made as a one-piece unit; and/or the user must make an adjustment to control the venting aspect; and/or they are not easy to clean; and/or the mechanisms are none-the-less not designed to prevent movement; and or they are relatively complicated in design or in manufacturing.

As two of the biggest issues with baby bottle venting mechanisms are leakage and cleaning, is an object of the present invention to provide an improved container and venting mechanism assembly that addresses at least these issues. Another object is to provide such an assembly that will not be affected by the user, in particular by the closing of the bottle (screwing the collar).

SUMMARY OF THE INVENTION

The present invention relates to a vented (closed) container, for example a food storage container or a bottle; and a venting mechanism assembly therefor.

Examples of bottles that can implement the present venting mechanism assembly include "sport bottles", "bicycle bottles" and the like.

In accordance with embodiments of one aspect of the present invention there is provided a venting mechanism assembly for a closed container having a lid and a container portion with a neck and a rim, the assembly comprising: a venting unit comprising: a substantially rigid ring having a lid-interfacing surface; and a resilient annular valve member having a one-way valve disposed at the inner wall of the neck. The assembly further comprises at least one air passageway leading from the ambient atmosphere to the one-way valve member; and a fixing mechanism adapted to prevent planar movement between the venting unit and the container. Thus, the one-way valve seals at the inner wall of the neck when there is an under-pressure, below a thresh-hold level, inside the container and where the valve is opened upon an under-pressure, above a thresh-hold level within the container.

In some embodiments the rigid ring and resilient member are formed into a singular piece. In some embodiments the fixing mechanism comprises at least three respective corresponding male-female parts. In some embodiments the corresponding male-female parts are respectively constituted by four projections from the rigid ring and four notches in the rim of the container.

In some embodiments the one-way valve is constituted by an annular skirt. In some embodiments the one-way valve is constituted by at least one flap. In some embodiments the at least one flap is a plurality of flaps, in particular four flaps.

In some embodiments the at least one air passageway comprises at least one recess in the rigid ring. In some embodiments the at least one air passageway comprises at least one recess in the resilient member. In some embodiments the least one air passageway comprises at least one recess in the rigid ring and at least one recess in the resilient member. In some embodiments the at least one air passageway comprises at least one venting canal in the rim of the container. In some embodiments the at least one air passageway comprises at least one through-hole in the neck of the container.

In some embodiments the lid-interfacing surface of the rigid ring is adapted to interface with a nipple flange of a baby bottle. In some embodiments the rigid ring comprises a rim interface surface.

In accordance with embodiments of another aspect of the present invention there is provided a method of venting a closed container, the method comprising: providing a venting unit comprising: a substantially rigid ring having a lid-interfacing surface; and a resilient annular valve member having a one-way valve; providing an air passageway of the venting unit in combination with the container; and fixing the venting unit onto the container so that the venting unit is planarly fixed with respect to the rim of the container.

In some embodiments fixing the venting unit onto the container includes aligning at least three corresponding projections and notches.

The term "container" and "closed container" herein the specification and claims will be used in its broadest sense and includes any closed/closable container suitable or adaptable to incorporate the present venting mechanism assembly. The stipulation of the term "closed container" is used merely to indicate that a lower than ambient pressure can be achieved in the container, at least temporarily. Such containers may include, but are not necessarily limited: to storage containers such as food and clothing storage containers; and bottles, such as baby bottles, "sport bottles", bicycle bottles and the like, which may benefit from introducing a fluid, typically air, into the container to reduce the under-pressure inside the container.

Throughout the specification and claims, the term "air" should be understood to include any appropriate fluid. Also, the term's "container", "closed container" and "bottle" may be used interchangeably.

The terms "lid", "cap", "top" and "cover" may be used interchangeably to denote the component(s) that close the container/bottle at the neck or rim thereof.

Potential advantages of the present invention include at least one of the following:

The venting unit is detachable from the bottle for easy cleaning. The design, in particular the fixing mechanism between the venting unit and the bottle, provides high precision and accurate assembly to help preclude leakage through the valve and vent. The fixing mechanism assures alignment of corresponding components of the assembly and prevents movement of the venting unit relative to the bottle (rim) in all planar directions (front-back, side to side and rotationally), which prevents deformation of the flexible flap/skirt (vent) and helps produce appropriate sealing. This planar fixing mechanism fixes and centralizes the venting unit resulting in improved sealing characteristics to prevent leakage; and matching of corresponding/interfacing components resulting in consistent valve functioning. The venting unit is formable as a one-piece component and is therefore is both easy to clean and assemble (mate with the bottle's neck/rim).

It should be understood that to suit bottles having different diameter rims, the venting unit will be accordingly sized.

The resilient portion of the present venting mechanism assembly is not integral with the nipple and thus not necessarily made of the same material as the nipple—so is not limited. In contrast, prior art venting mechanisms where the vent is integral with the nipple, the vent and nipple are made from the same material and have the same resiliency. In the present venting mechanism assembly, the vent and valve can be made of any suitable resilient material, and thus is not limited to a specific material.

BRIEF DESCRIPTION OF THE DRAWINGS

The present invention will be understood and appreciated more fully from the following detailed description taken in conjunction with the appended drawings in which:

FIG. 5 is an more detailed view of the fixing mechanism of;

The following detailed description of embodiments of the invention refers to the accompanying drawings referred to above. Dimensions of components and features shown in the figures are chosen for convenience or clarity of presentation and are not necessarily shown to scale. Wherever possible, the same reference numbers will be used throughout the drawings and the following description to refer to the same and like parts.

DETAILED DESCRIPTION OF EMBODIMENTS OF THE INVENTION

Illustrative embodiments of the invention are described below. In the interest of clarity, not all features/components of an actual implementation are necessarily described.

Figure 1:
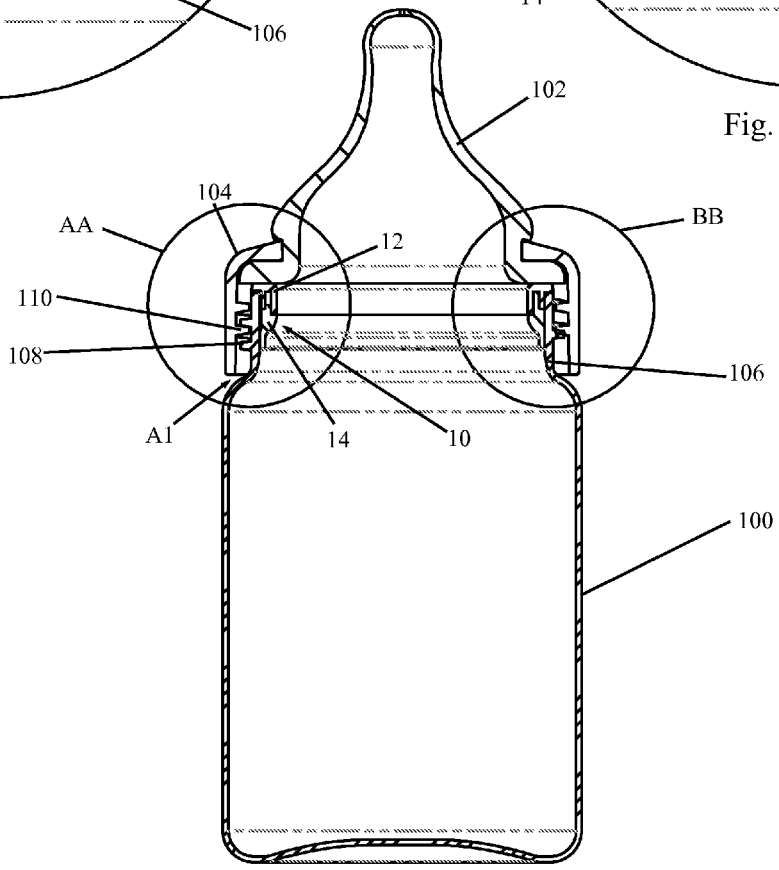
FIG. 1 is a cross-sectional view from the side of an embodiment of a container and venting mechanism assembly, the container exemplified by a baby bottle.

FIGS. 1-4 show an embodiment, including modifications thereto, of the present invention. FIG. 1 shows a baby bottle having a container portion 100 and a cover, cap, lid, top, etc; which in the case of the baby bottle is typically constituted by a resilient teat or nipple 102 together with a nipple ring or collar 104. Container portion 100 typically has a mouth defined by a neck 106 having external threads 108 for engaging with internal threads 110 of collar 104. Neck 106 also has a rim 112. In the present assembly, rim 112 has four notches 50, individually designated 50N, 50S, 50E, 50W (FIG. 4), arranged substantially at "north", "south", "east" and "west" positions relative to each other, i.e. every ninety degrees. More notches 50 can be used, and potentially as few as three will provide suitable fixing, preferably equally spaced along rim 112; however it is preferable that there are at least four notches to preclude movement in all planar directions (front-back, side to side and rotational).

The design of neck 106 and threads 108 and 110 are such that that air can pass along the threads, indicated by arrow A1, and which is common for baby bottles with a venting system.

The present assembly includes one-piece ring-shaped venting unit 10. The one-piece ring-shaped venting unit 10 comprises a rigid ring 12; and an annular valve member 14. Rigid ring 12 and valve member 14 typically having correspondingly shaped interfacing surfaces. The valve member 14 is made of a resilient material such as silicon rubber and is typically over-molded onto the rigid ring 12, which is typically plastic. In some embodiments, ring 12 and valve member 14 are adapted to fit together via a male-female fit, as shown.

Figure 3:
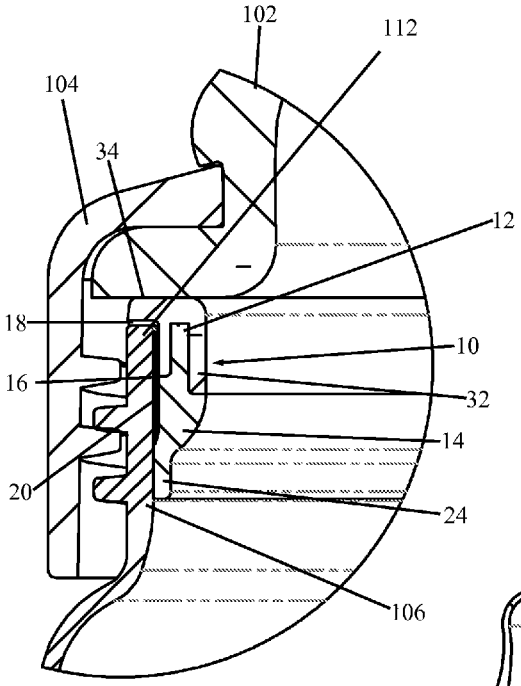
FIG. 3 is a enlarged view of portion BB of FIG. 1.

Referring to FIG. 3, air passageways or air channels 18 (one seen) are defined by recesses 16 in rigid ring 12 and opposing rim 112 (and typically the inner wall of neck 106). There is preferably a plurality of air channels 18, so that regardless of the angle in which the bottle 100 is tipped for drinking, one or more of the channels 18 will likely be exposed to air inside the bottle—however, this is not strictly necessary. In some embodiments, the air channels 18 are also (or alternatively) defined by correspondingly positioned recesses 20 in valve member 14. Valve member 14 also comprises a valve, which in some embodiments includes a continuous skirt 24 (FIG. 4) adapted to interface with the inner wall of neck 106. Valve member 14 also typically includes one or more annular seals 28 for sealing against neck 106.

Skirt 24 acts as a one-way valve to prevent leakage during shaking or tipping of the bottle 100. In the embodiment shown in FIG. 4, rigid ring 12 and skirt 24 do not include recesses 16 or 20 for forming air channels 18, rather the venting air flow at the skirt is provided for by inward movement of the skirt upon a threshold under-pressure in the bottle 100.

Figure 8:
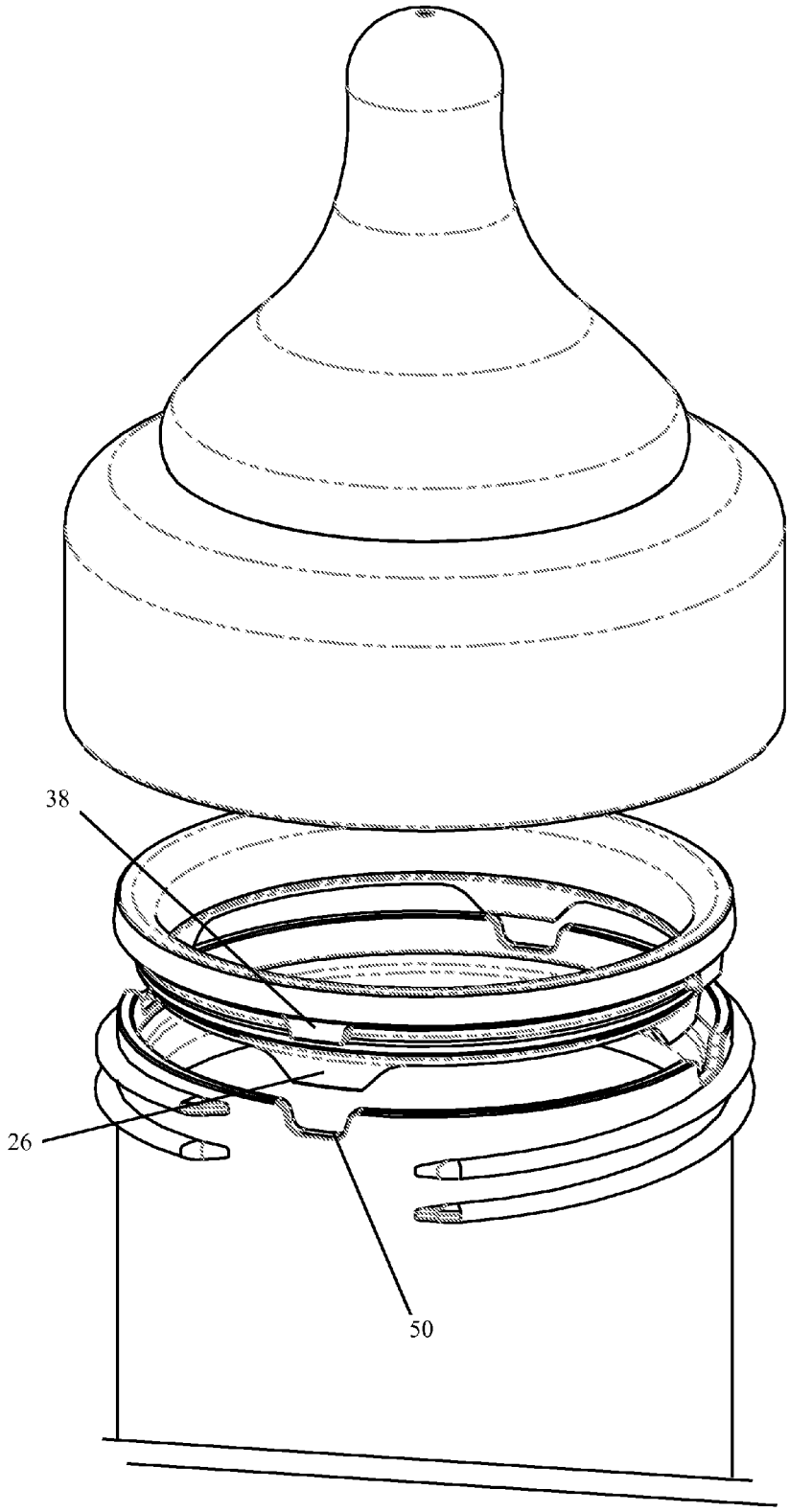
FIGS. 8-11 are perspective views illustrating additional embodiments of the venting mechanism assembly.
Figure 9:
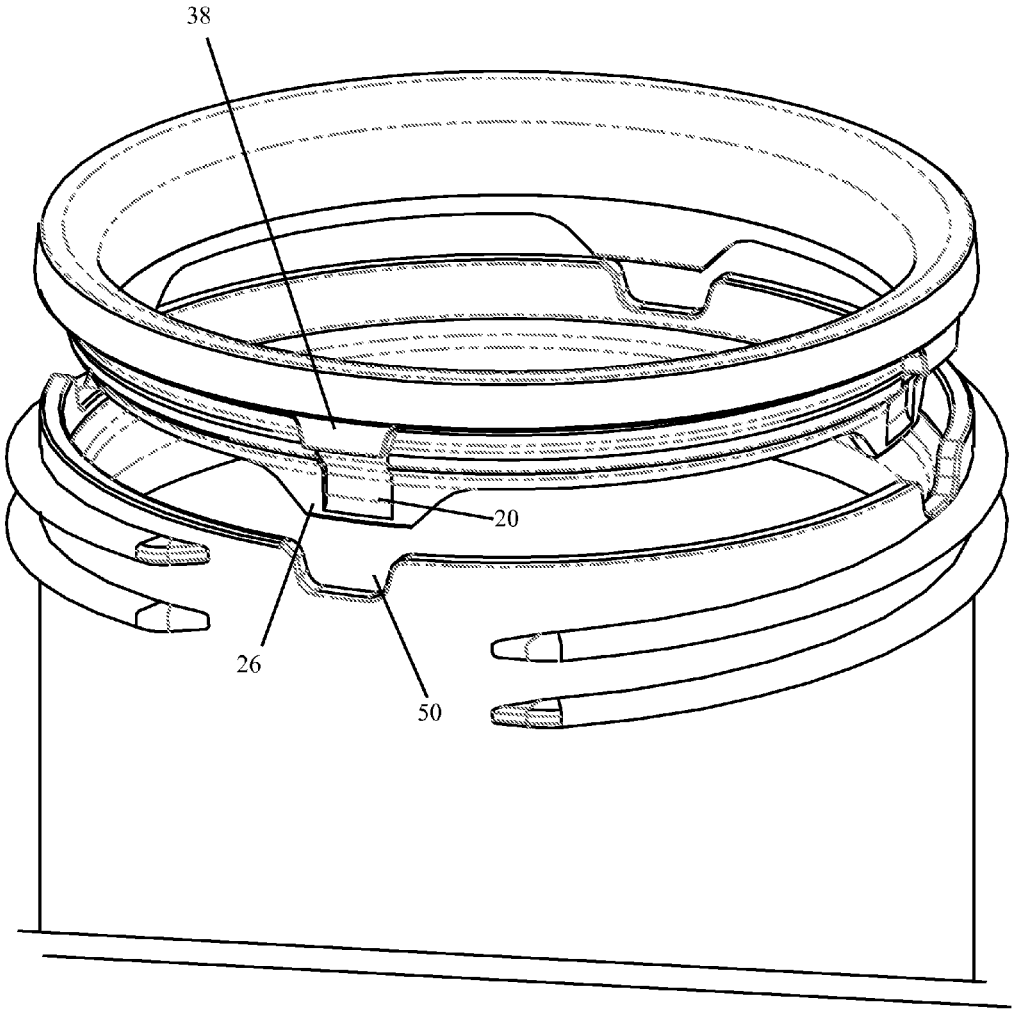
Figure 10:
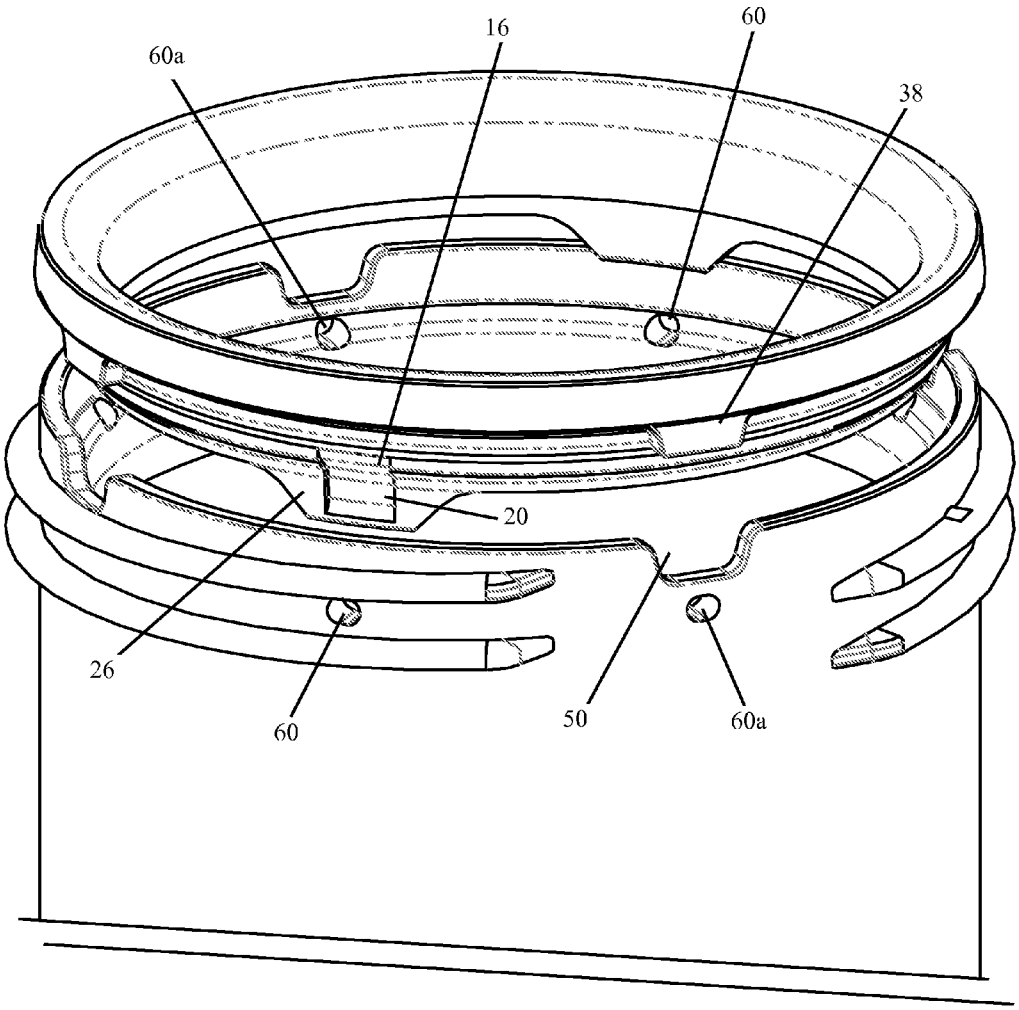

Rigid ring 12 has a rim-interface surface 30 (FIG. 2) where the ring 12 rests on rim 112. In the particular embodiment shown, this rim-interface surface 30 also extends downward, abutting, or at least adjacent, the inner wall of the neck 106. Rigid ring 12 also has a valve member reinforcing arm 32 for providing support to valve skirt 24 or valve flaps 26 (FIGS. 8-10). The venting feature is formed by a combination of venting unit 10 (comprising rigid ring 12 plus annular valve member 14) and rim 112 plus neck 106 of bottle 100.

In some embodiments (not shown) valve member 14 is designed to have a portion thereof intermediate the rigid ring 12 and rim 112 and thus interfaces with the rim. In such a case, typically only valve member 14 comprises for example recesses 20, to form air passageways or air-channels 18. In other words, in some designs only the valve member 14 will interface with the rim 112.

Rigid ring 12 has a lid interfacing surface 34, which is a generally upper surface or upper and outer surface intended for interfacing with a container lid, which in the case of a baby bottle the interface is typically with nipple 102.

Valve member 14 is typically made of a resilient material, for example silicone or rubber.

The one-way valve (exemplified by skirt 24 or flap(s) 26) is designed to abut the inner wall of neck 106 when in a closed position. The one-way valve is positioned at least opposite air-channel(s) 18 to prevent leakage of baby formula or other liquid, which can occur for example during shaking or tipping of the bottle when drinking. However, when a baby is drinking the pressure in the bottle is lower than the ambient pressure causing the one-way valve (e.g. a portion of skirt 24; or one or more of flaps 26) to bend toward the interior of the bottle whereby ambient air can enter the bottle via one or more of channels 16.

It is envisioned that when manufacturing the venting unit 10, the typically silicone valve member 14 is over-molded onto the rigid ring 12 thereby producing a singular one-piece unit which is thereby convenient to handle and clean. However, in other embodiments it is possible to utilize rigid ring 12 and member 14 as separate pieces.

Figure 2:
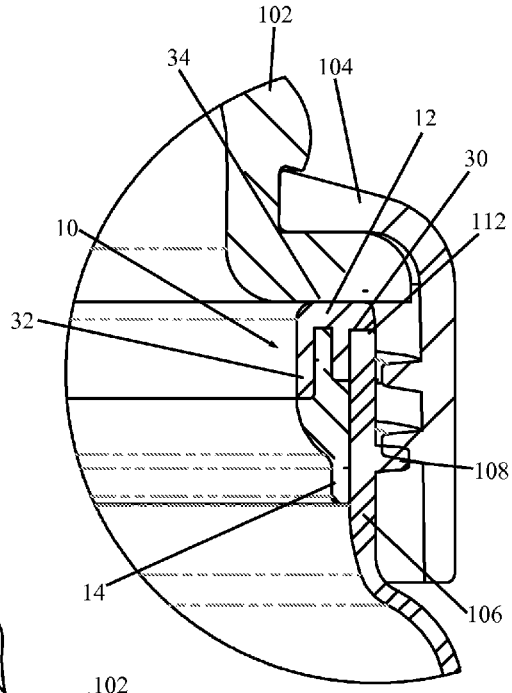
FIG. 2 is a enlarged view of portion AA of FIG. 1.
Figure 4:
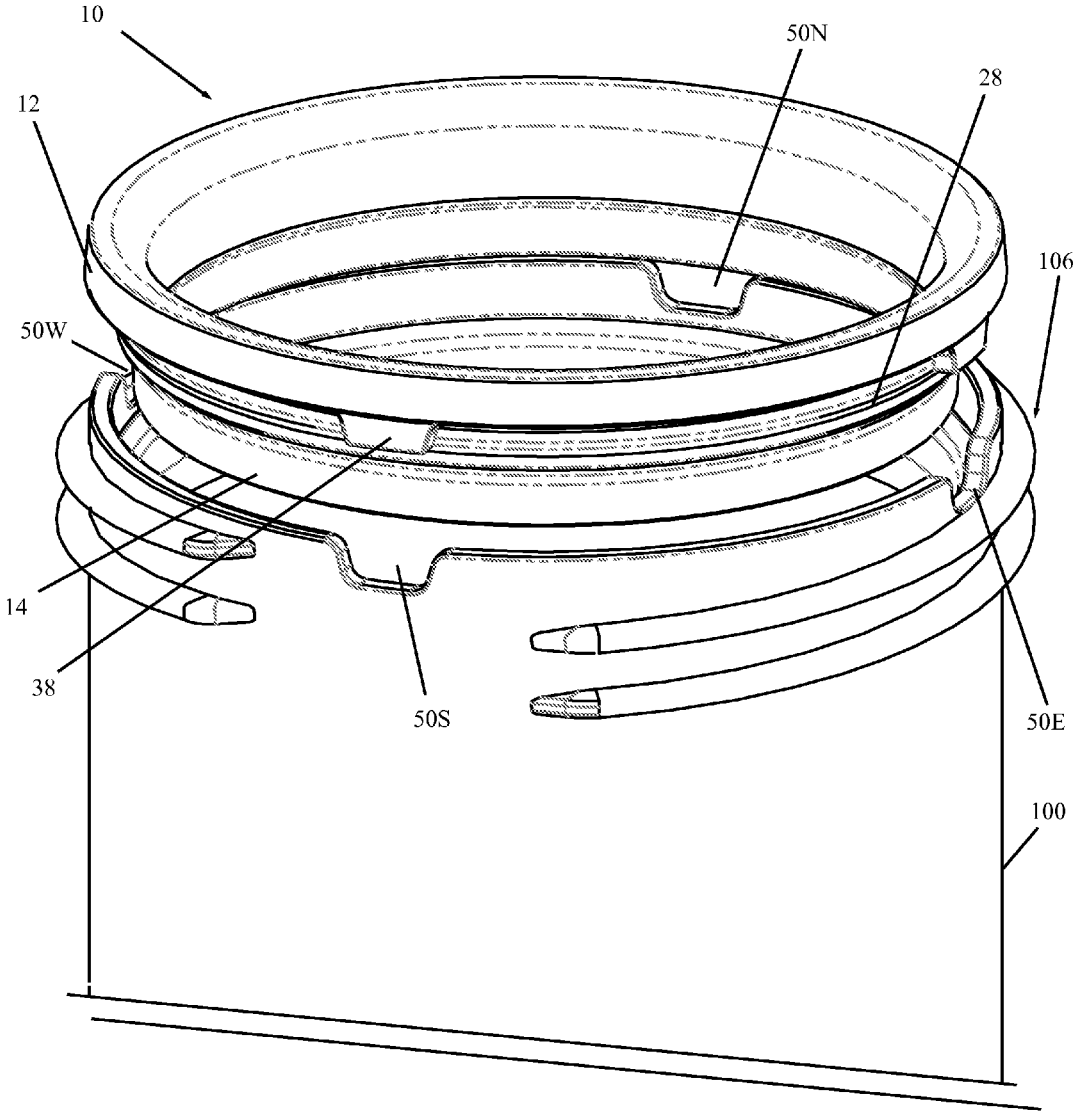
FIG. 4 is a perspective view of the present container and venting mechanism assembly illustrating an exemplary fixing mechanism therefor.
Figure 5:
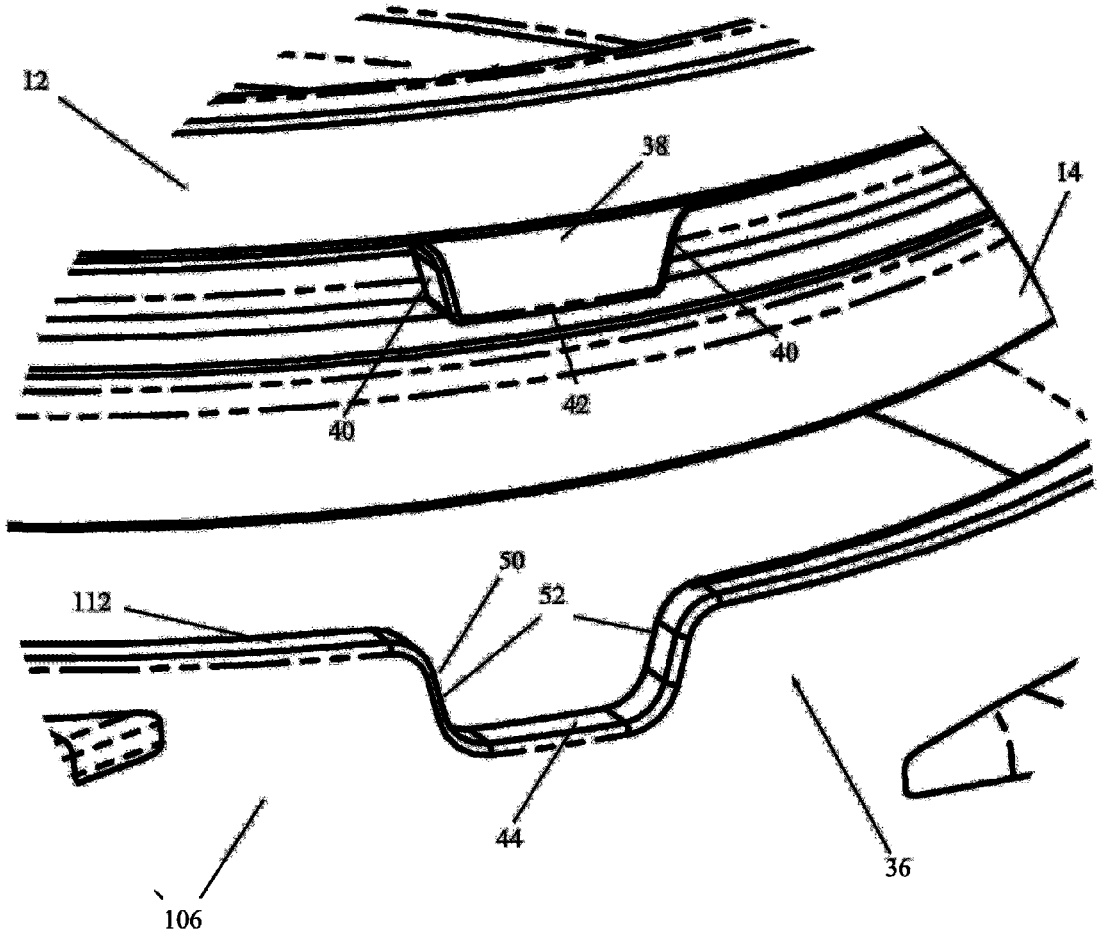
Figure 6:
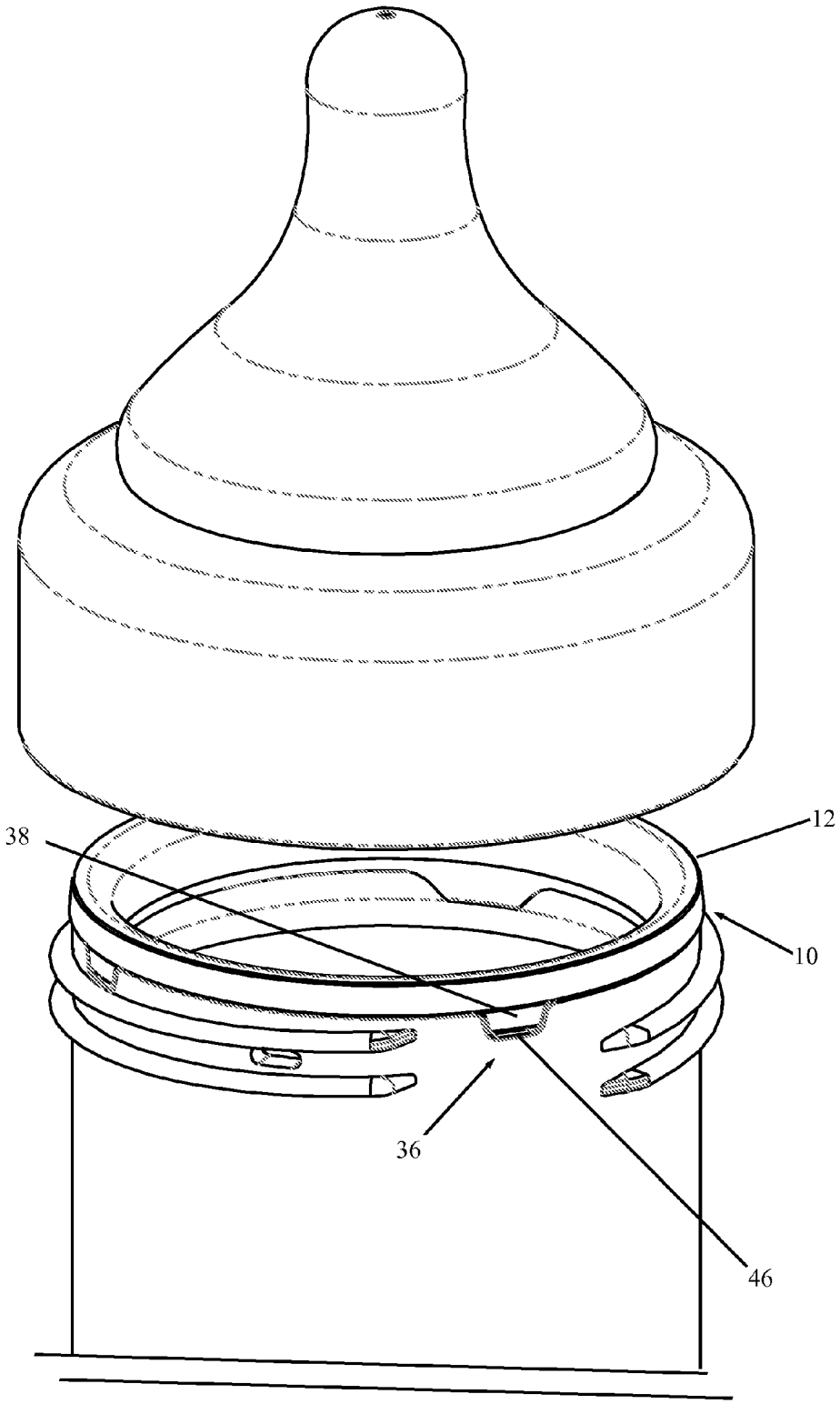
FIG. 6 is a view similar to FIG. 4, with the venting unit assembled to the bottle.

FIGS. 4, 5 and 6 illustrate an embodiment of a fixing mechanism 36 of the assembly for fixing the venting unit 10 at a particular planar position with rim 112 to prevent planar movement between the venting unit and the rim. Fixing mechanism 36 comprises a plurality of rigid projections 38 (four shown) and corresponding notches 50 (50N, 50S, 50E, 50W). Projections 38 are integrally formed with rigid ring 12 and typically depend from or are adjacent to rim-interface surface 30 (FIG. 2). Projections 38 have angled side walls 40 tapering toward each other in the direction of notches 50. Notches 50 have correspondingly tapering angled side walls 52. Projections 38 and notches 50 also have respective opposing surfaces 42 and 44; surface 42 of the projections being an outer surface thereof, and surface 44 being a lower surface of the notches. Thus, fixing mechanism 36 prevents turning/spinning/twisting and back-forth and side to side movement, any of which can potentially cause or allow deformation and disturb the seal. Projections 38 and notches 50 are dimensioned, in particular the distance between both side walls 40 and 52 thereof, respectively, so that when the projections rest inside of the notches, there is a gap 46 (FIG. 6) between surfaces 42 and 44 defining part of air channel 18. Depending upon the particular configuration and dimensions of venting unit 10, the aforementioned gap can obviate the need for recesses 16 in rigid ring 12 and potentially also obviate the need for recesses 20 in valve member 14.

Figure 7:
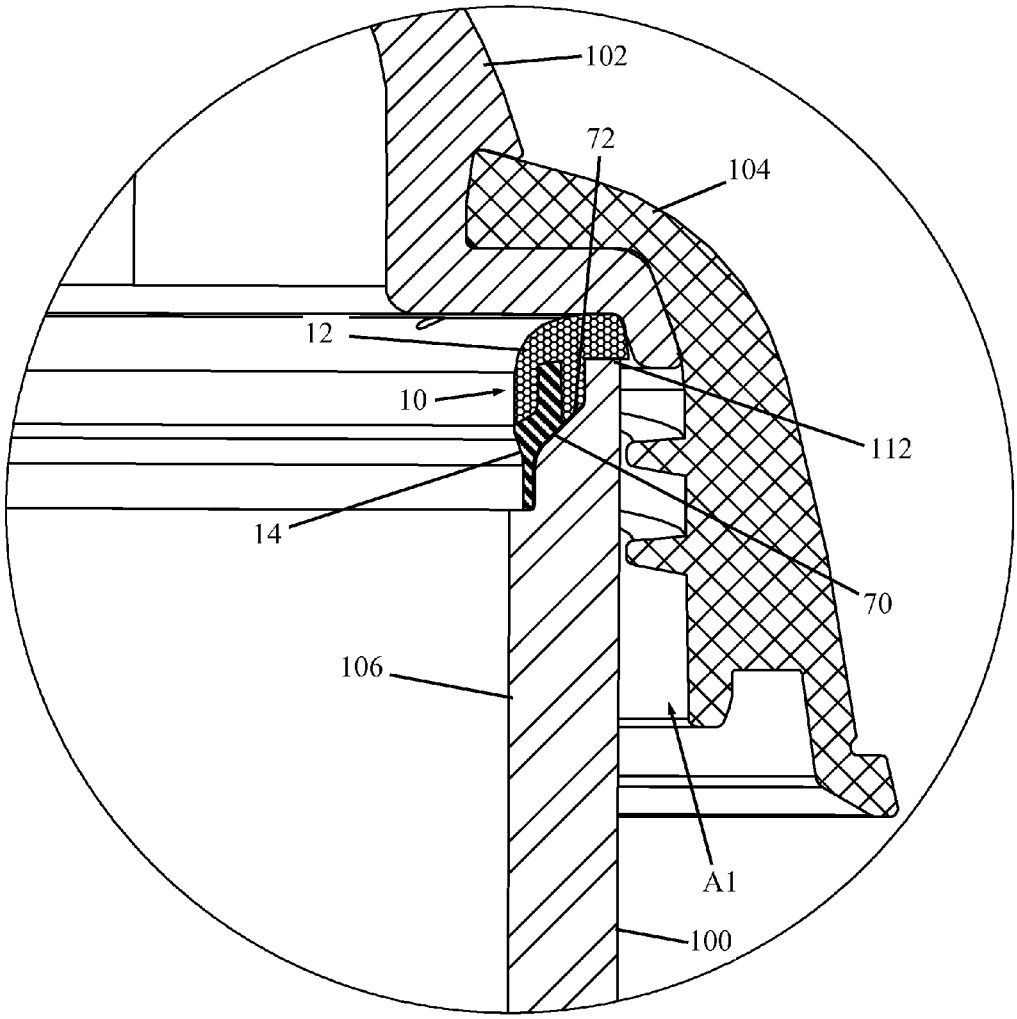
FIG. 7 is a sectional view illustrating another embodiment of the container and venting mechanism assembly of the present invention.

FIG. 7 depicts another modification of the present assembly wherein venting unit 10 and rim 112 have corresponding interfaces surfaces, for example stepped surfaces 70 and 72, respectively—although other interface shapes, e.g. beveled, grooved and so on, are possible. Such designs and various alternatives thereto may provide improved mating of parts and fixing of the venting unit 10 on the rim 112. Furthermore, such configurations facilitate the implementation of designs wherein the venting unit 10 is inboard of the inner wall of the neck 106, i.e. inboard of the mouth of the bottle 100 so that the entire mouth opening is active. Such configurations may facilitate cleaning of the bottle 100 with the venting unit 10 still fixed thereto.

When in use, the air-channel(s) 18 (FIG. 3) and one-way vent of produced by venting unit 10 interfacing at least the rim 112 (and in some embodiments also the inner wall of the neck 106) allow ambient air to enter the bottle 100 when there is an under-pressure therein which causes an inward movement of the one-way valve (comprising for example skirt 24 or one or more flaps 26). When the under-pressure is significantly lessened, the one-way valve closes to prevent leakage.

Figure 11:
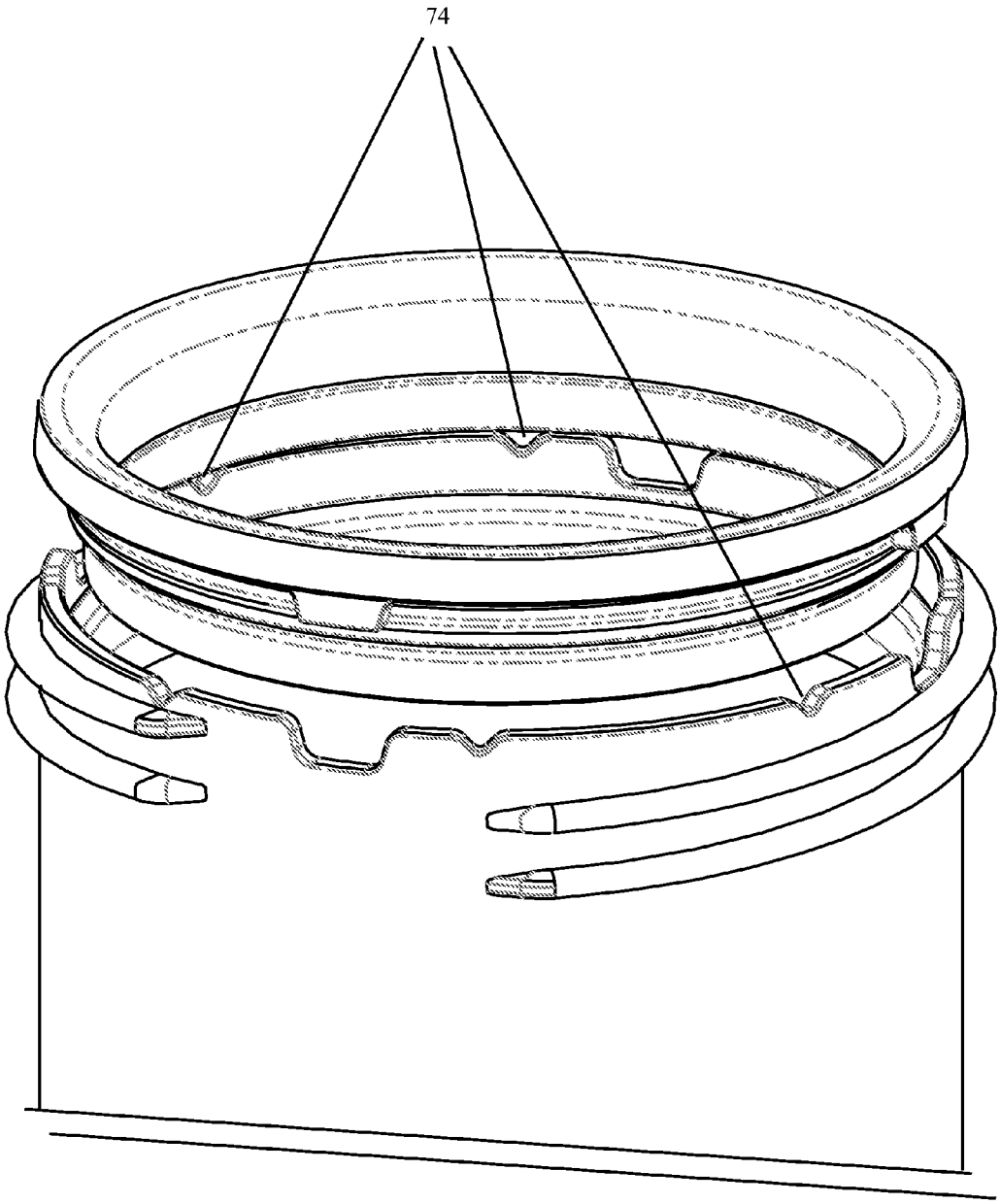

FIGS. 8-11 illustrate further exemplary embodiments, wherein the venting mechanism assembly comprises other venting/air-channel designs. In FIGS. 8-10 the one-way valve includes valve flaps 26, as mentioned above (e.g. four flaps). In FIGS. 8 and 9, flaps 26 are correspondingly positioned adjacent to notches 50; whereas in FIG. 10 the flaps are not adjacent notches rather adjacent through-holes 60 in neck 106 which in some modifications act as auxiliary air passageways, i.e. are in addition to air-channel 18; and in other embodiments act as alternative air passageways, i.e. instead of air-channels 18; while in other modifications may be in place of such air-channels. There is typically a plurality of through-holes 60, as illustrated, which are typically evenly spaced apart along neck 106. According to a modification of the aforementioned design, some of the through-holes, designated 60*a*, are adjacent notches 50. In such designs, fixing mechanism 36 need not define a gap 46 (FIG. 6) and thus through-holes 60 could constitute a vent channel (i.e. instead of air-channel 18). FIG. 11 illustrates an embodiment wherein there is a plurality of small rim channels or venting canals 74 in rim 112. For replacing or augmenting the venting as provided by gap 46 and/or other venting designs.

Thus, exemplary embodiments of venting mechanism assemblies have been disclosed that take into account design considerations such as that: (a) the valve (e.g. skirt/flaps) needs to be precisely located on the inner wall of the bottle's neck to provide improved sealing; (b) the valve cannot be produced wherein it is a larger size than the inner diameter of the rim/neck of the bottle else the valve will not properly be insert-able into the neck and/or the skirt/flaps will have a waviness and not form a high quality seal resulting in possible leakage; (c) the valve alone is not sufficiently strong to fix the venting unit in place as the valve skirt/flap(s) must be made from a resilient material which is too soft to prevent movement upon tightening of the collar.

It should be understood that the above description is merely exemplary and that there are various embodiments of the present invention that may be devised, mutatis mutandis, and that the features described in the above-described embodiments, and those not described herein, may be used separately or in any suitable combination; and the invention can be devised in accordance with embodiments not necessarily described above.

The invention claimed is:

1. A venting unit assembly for a closed container having a lid and a container portion with a neck and a rim, the rim having at least three spaced apart notches, the unit assembly comprising:

a venting unit comprising:

a substantially rigid ring having a lid-interfacing surface; and a resilient annular valve member interfacing with the substantially rigid ring comprising a one-way valve adapted to be disposed at the inner wall of the neck, wherein the resilient annular valve member does not interface with the lid;

wherein the substantially rigid ring has at least three spaced apart projections arranged correspondingly with the rim's spaced apart notches thereby forming a fixing mechanism for fixing said substantially rigid ring and said resilient annular member in place with respect to the container portion to prevent movement there-between including during closure of the lid;

and wherein there is a gap between said projections and said notches thereby forming at least one air passageway between one of said projections and one of said notches of said fixing mechanism, the said assembly further comprising at least one air passageway leading from the ambient atmosphere to the one-way valve member;

and a fixing mechanism adapted to prevent planar movement between the venting unit and the container, whereby the one-way valve seals at the inner wall of the neck when there is a pressure difference between the ambient atmosphere and the inside of the container, below a threshold pressure; and the one-way valve is opened when there is a pressure difference between the ambient atmosphere and the inside of the container above a threshold pressure.

2. The unit according to claim 1, wherein the rigid ring and resilient member are formed into a singular piece.

3. The unit according to claim 1, wherein the fixing mechanism is constituted by four projections from the substantially rigid ring and four corresponding notches in the rim of the container.

4. The unit according to claim 1, wherein the one-way valve is constituted by an annular skirt.

5. The unit according to claim 1, wherein the one-way valve is constituted by at least one flap.

6. The unit according to claim 5, wherein the at least one flap is a plurality of flaps.

7. The unit according to claim 6, wherein there are four flaps.

8. The unit according to claim 1, wherein the at least one air passageway comprises at least one recess in the rigid ring.

9. The unit according to claim 1, wherein the at least one air passageway comprises at least one recess in the resilient member.

10. The unit according to claim 1, wherein the at least one air passageway comprises at least one recess in the rigid ring and at least one recess in the resilient member.

11. The unit according to claim 1, wherein the at least one air passageway comprises at least one venting canal in the rim of the container.

12. The unit according to claim 1, wherein the at least one air passageway comprises at least one through-hole in the neck of the container.

13. The unit according to claim 1, wherein the lid-interfacing surface of the rigid ring is adapted to interface with a nipple flange of a baby bottle.

14. The unit according to claim 1, wherein the rigid ring comprises a rim interface surface.

15. A method of venting a closed container having a lid and a container portion with a neck and a rim, the rim having at least three spaced apart notches, the method comprising:

providing a venting unit comprising: a substantially rigid ring having a lid-interfacing surface and at least three spaced apart projections arranged to correspond to the rim's notches; and a resilient annular valve member interfacing with the substantially rigid ring and having a one-way valve disposed at the inner wall of the neck;

providing an air passageway of the venting unit in combination with the container between said notches and said projections; and fixing the venting unit onto the container so that the venting unit is planarly fixed with respect to the rim of the container including during closure of the lid, consisting of aligning said projections and said notches, whereby the one-way valve of the venting unit seals at the inner wall of the neck of the container when there is a pressure difference between the ambient atmosphere and the inside of the container, below a threshold pressure; and the one-way valve is opened when there is a pressure difference between the ambient atmosphere and the inside of the container above a threshold pressure.

16. The method according to claim 15, wherein fixing the venting unit onto the container comprises aligning at least four spaced apart projections and corresponding notches of the rim.

17. The method according to claim 15, wherein fixing the venting unit onto the container comprises fixing the venting unit onto a baby bottle.

18. The method according to claim 15, further comprising forming the rigid ring and resilient member into a singular piece prior to fixing the venting unit onto the container.

19. The method according to claim 15, further comprising providing the at least one air passageway with at least one recess in the rigid ring.

* * * * *